US011700921B2

(12) United States Patent
Kim

(10) Patent No.: US 11,700,921 B2
(45) Date of Patent: Jul. 18, 2023

(54) 360 DEGREE ROTATABLE ACCESSORY

(71) Applicant: REX DIAMOND CO., LTD., Seoul (KR)

(72) Inventor: Won Ku Kim, Hanam-si (KR)

(73) Assignee: REX DIAMOND CO., LTD., Seoul (KR)

( * ) Notice: Subject to any disclaimer, the term of this patent is extended or adjusted under 35 U.S.C. 154(b) by 0 days.

(21) Appl. No.: 17/500,063

(22) Filed: Oct. 13, 2021

(65) Prior Publication Data

US 2022/0047049 A1 Feb. 17, 2022

Related U.S. Application Data

(62) Division of application No. 15/754,860, filed as application No. PCT/KR2015/014283 on Dec. 24, 2015, now Pat. No. 11,178,945.

(30) Foreign Application Priority Data

Oct. 23, 2015 (KR) ..... 10-2015-0148094

(51) Int. Cl.

| | |
|---|---|
| ***A44C 15/00*** | (2006.01) |
| ***A47G 33/08*** | (2006.01) |
| ***A47G 33/10*** | (2006.01) |
| ***A44C 17/02*** | (2006.01) |
| *A44C 7/00* | (2006.01) |

(52) U.S. Cl.
CPC ..... *A44C 17/0258* (2013.01); *A44C 15/00* (2013.01); *A44C 7/00* (2013.01)

(58) Field of Classification Search
CPC ..... A44C 13/00; A44C 25/001; A44C 25/005; A44C 25/007; A44C 17/0258; A44C 15/00; A44C 7/00; F16B 45/00; F16B 2200/403; F16B 2200/406; F16B 2/005; A47G 25/32; B66C 1/34
USPC ..... 24/370, 376, 3.11, 3.12; 248/303, 304; 403/69, 70, 78, 371, 164, 147; 81/177.85
See application file for complete search history.

(56) References Cited

U.S. PATENT DOCUMENTS 1,404,807 A * 1/1922 Tait ..... F16B 45/00 248/304
2,466,243 A * 4/1949 Johnson ..... A01K 91/03 59/95
2,918,335 A * 12/1959 Fruendt ..... F16C 19/364 384/618
3,003,149 A * 10/1961 Grashow ..... H01Q 1/1207 343/900

(Continued)

FOREIGN PATENT DOCUMENTS

CN 201905351 U 7/2011
DE 102010007187 A1 7/2011

(Continued)

*Primary Examiner* — Jack W Lavinder
(74) *Attorney, Agent, or Firm* — NKL Law; Jae Youn Kim

(57) ABSTRACT

Provided is a 360-degree rotatable accessory. The 360 degree rotatable accessory can be used for various purposes such as a decoration of a bag, or a finger ring, a necklace, a bracelet, and an earring, can be rotated a predetermined angle, that is, 360 degrees around a coupling portion, that is, a body, and can be transformed into various shapes because it can be rotated a desired angle and firmly maintained at the angle, thereby having high commercial value and quality.

5 Claims, 6 Drawing Sheets

(56) References Cited

U.S. PATENT DOCUMENTS

| | | | | |
|---|---|---|---|---|
| 6,332,734 | B1 * | 12/2001 | Hebert | B23B 31/202<br>403/368 |
| 8,191,849 | B1 * | 6/2012 | Lembke | A47G 7/047<br>248/692 |
| 2014/0202910 | A1 * | 7/2014 | Hollander | B65D 51/242<br>206/457 |

FOREIGN PATENT DOCUMENTS

| | | | |
|---|---|---|---|
| KR | 20-0208907 | Y1 | 1/2001 |
| KR | 10-0923318 | B1 | 10/2009 |
| KR | 10-2010-0078242 | A | 7/2010 |
| KR | 10-2011-0043389 | A | 4/2011 |
| KR | 20-0466895 | Y1 | 5/2013 |
| KR | 10-1521992 | B1 | 5/2015 |
| TW | 201424646 | A | 7/2014 |

* cited by examiner

360 DEGREE ROTATABLE ACCESSORY

CROSS-REFERENCE TO RELATED APPLICATIONS

This application is a divisional of U.S. application Ser. No. 15/754,860, filed Feb. 23, 2019, which is a national stage application of PCT/KR2015/014283, filed Dec. 24, 2015, which claims priority to KR 10-2015-0118848, filed Aug. 24, 2015 and KR 10-2015-0148094, filed Oct. 23, 2015, the entire disclosures of which are incorporated herein by reference.

TECHNICAL FIELD

The present invention relates to an accessory and, more particularly, to a 360-degree rotatably accessory that can be used for various purposes such as a decoration of a bag, or a finger ring, a necklace, a bracelet, and an earring, and particularly can be transformed into various shapes because it can be rotated 360 degrees.

BACKGROUND ART

In general, an accessory, which is a term meaning all ornaments such as an earring, a necklace, and a bracelet, is an object fabricated in various designs and for various uses. Such an object has been habitually used by both men and women throughout history.

In the course of history, accessories have been fabricated to be worn around parts of the body of a user such as a neck, a finger, and a wrist through a lace or a ring for a necklace, a finger ring, and a bracelet. Recently, piercing that was used for wearing an earring is now being applied to other parts such as a nose, a lip, and a navel.

Further, recently, various accessories that can be attached to bags such as a handbag or can be used for other purposes have been proposed to satisfy various customer demands and the accessory disclosed in Korean Patent Application Publication No. 10-2009-0125934 is one such example.

This accessory allows for free replacement of jewels and can be used for various purposes, but the structure is very complicated and various parts are required, so the manufacturing cost is high and the productivity is low.

Further, the most fatal problem is that the accessory cannot be variously implemented, thus commercial value is low because it is fixed at the coupling portion, that is, the accessory cannot be rotated.

DISCLOSURE

Technical Problem

In order to solve the problems, and object of the present invention is to provide a 360-degree rotatable accessory that can be used for various purposes such as a decoration of a bag, or as a finger ring, a necklace, a bracelet, and an earring, can be rotated a predetermined angle at a coupling portion, that is, 360 degrees, and can be transformed into various shapes because it can be rotated in a desired direction and firmly maintained at the angle, thereby having high commercial value and quality.

Technical Solution

A 360 degree rotatable accessory according to a first embodiment of the present invention includes: a body having an insertion groove having a predetermined depth and formed at the center, slots longitudinally formed on inner sides of the insertion groove, and a seat formed substantially around an inner side of a center thereof; an outer gear disposed on the seat of the body, having projections on an outer side thereof to correspond to the slots, and having teeth around an inner side thereof; an inner gear having teeth around an outer side thereof to be engaged with the teeth on the inner side of the outer gear, and having a contact groove at a center thereof; a spring disposed under the seat of the body to elastically support the inner gear; a cover having projections on an outer side thereof to be seated on the body and having a hole at a center thereof; and a rotary guider disposed over the cover, having a hook on a top thereof, having a guide rod extending at a lower end thereof to pass through the hole of the cover, and having a rectangular bar at a lower end of the guide rod to be fitted in the contact groove of the inner gear.

A 360-degree rotatable accessory according to a second embodiment includes: an outer body having threads formed upward from the body at a center on an inner side thereof and having a declined tapered hole formed in an upper portion; and an inner body fitted upward in the outer body, having threads on an outer side thereof to correspond to the outer body, having a tapered surface at an upper end, and having at least two or more slits formed from the upper end to a lower thread and arranged with regular intervals to apply or remove a tightening force to a lower end of the hook of the accessory through thread-fastening of the outer body.

A 360-degree rotatable accessory according to a third embodiment includes: a body having threads having a predetermined length and formed upward on an inner side of a lower portion thereof, and having a hole at a center of an upper portion so that a hook that is coupled to an accessory is guided therein; a first contact plate having a disc shape and formed at a lower end of the hook inserted in the body; and a coupler coupled upward to the body, having a threaded rod to be thread-fastened to the threads of the body, and having a second contact plate formed at an upper end of the threaded rod to be selectively brought in contact with the first contact plate.

According to another embodiment, anti-slip projections for preventing slip may be formed on any one of contact surfaces facing each other of the first and second contact plates.

Advantageous Effects

According to an embodiment of the present invention, the 360-degree rotatable accessory can be used for various purposes such as a decoration of a bag, or a finger ring, a necklace, a bracelet, and an earring, can be rotated a predetermined angle, that is, 360 degrees, around a coupling portion, that is, a body, and can be transformed into various shapes because it can be rotated a desired angle and firmly maintained at the angle, thereby having high commercial value and quality.

BEST MODE

A 360-degree rotatably accessory according to the present invention is described hereafter in detail with reference to the accompanying drawings.

Figure 1:
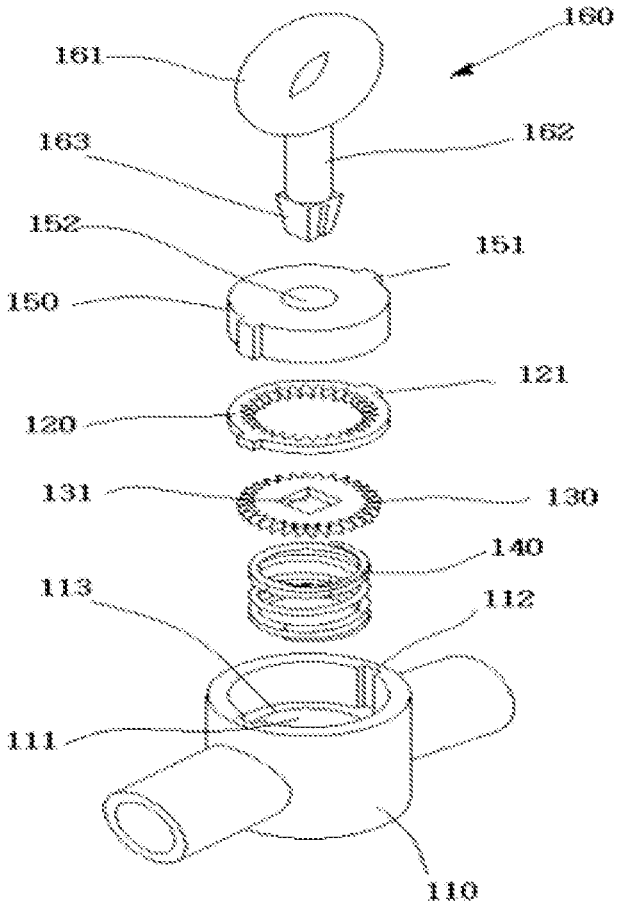
FIGS. 1 and 2 are exploded and assembled perspective views showing an embodiment of a 360-degree rotatable accessory according to the present invention.
Figure 2:
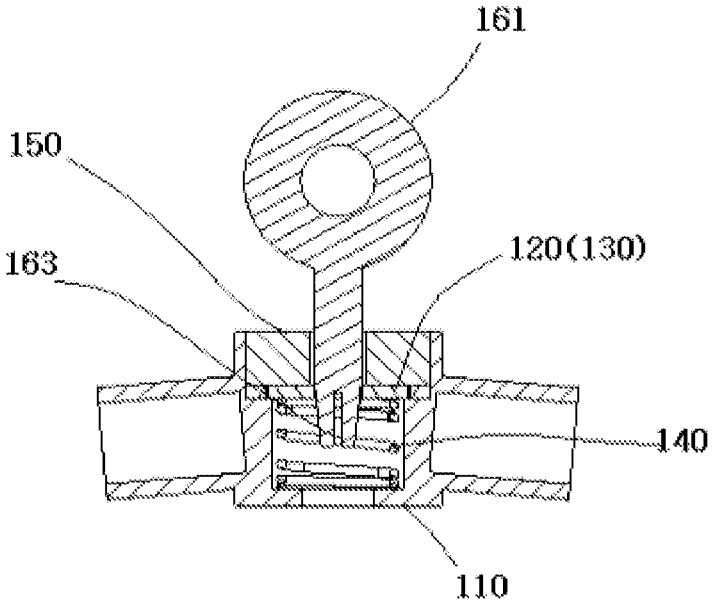
Figure 3:
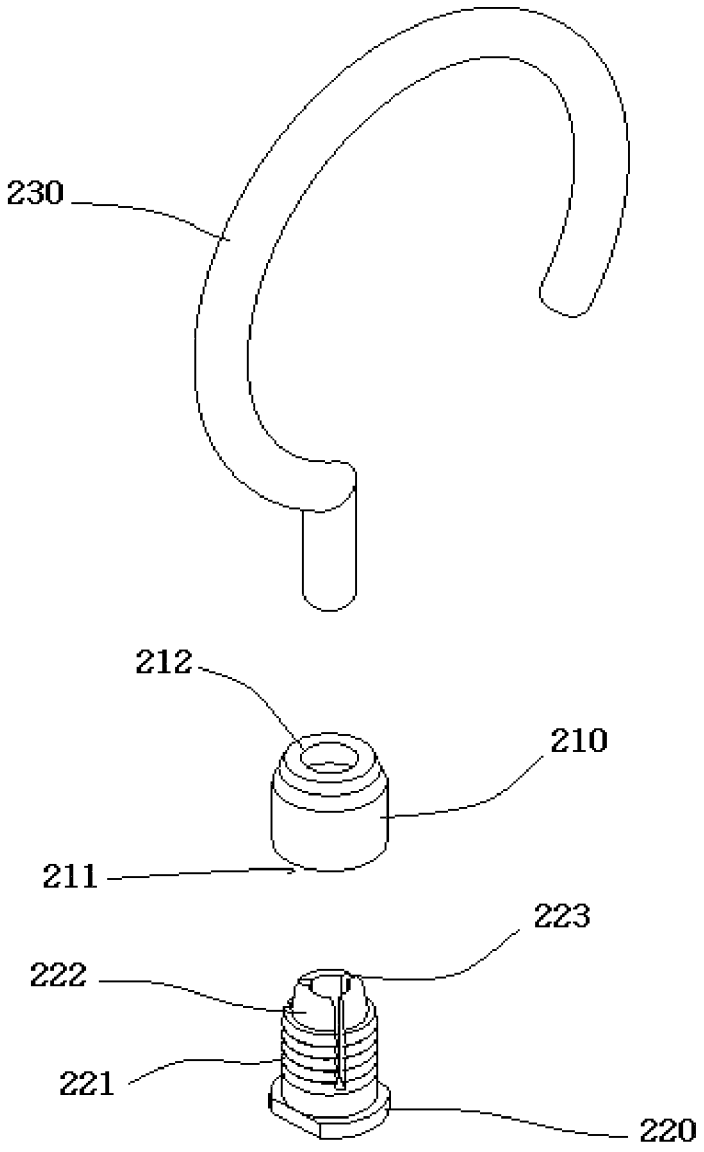
FIGS. 3 and 4 are exploded and assembled perspective views showing a second embodiment of a 360-degree rotatable accessory according to the present invention.
Figure 4:
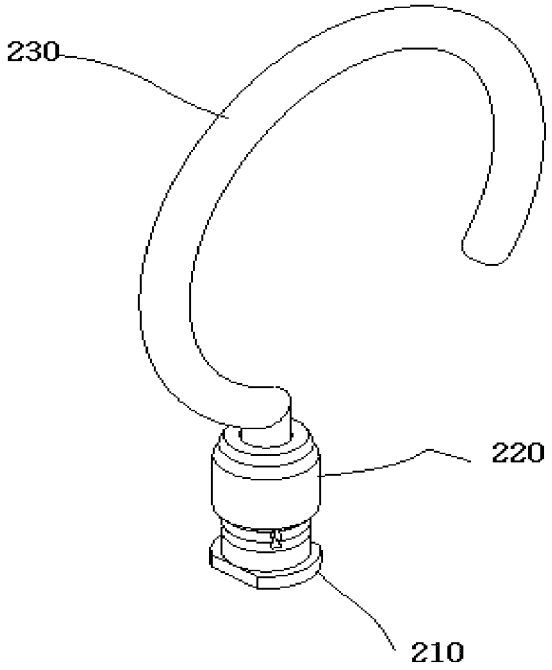
Figure 5:
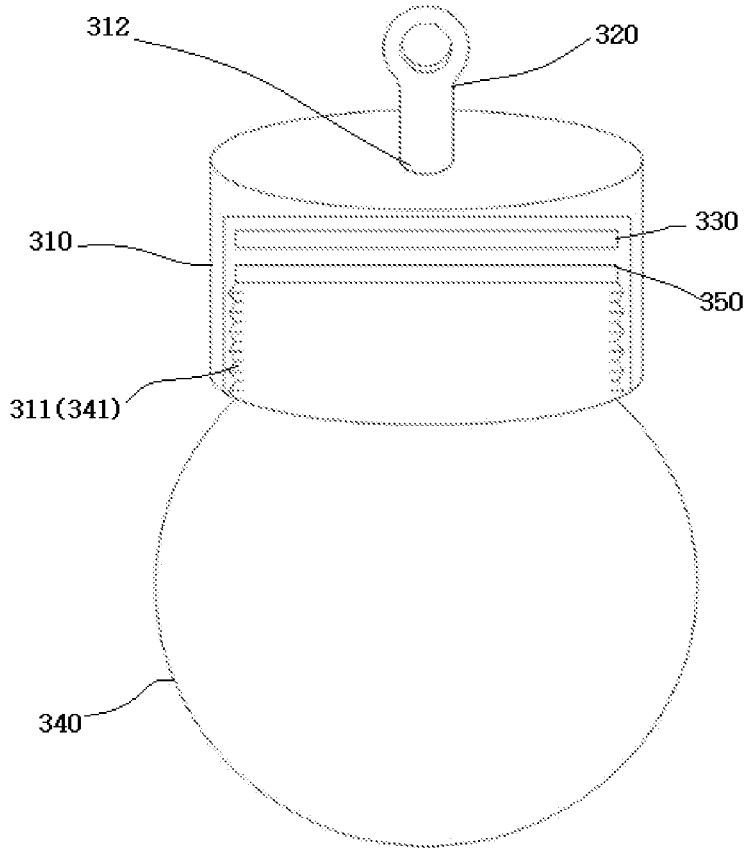
FIGS. 5 and 6 are a cross-sectional view and a perspective view showing main parts of a third embodiment of a 360-degree rotatable accessory according to the present invention.
Figure 6:
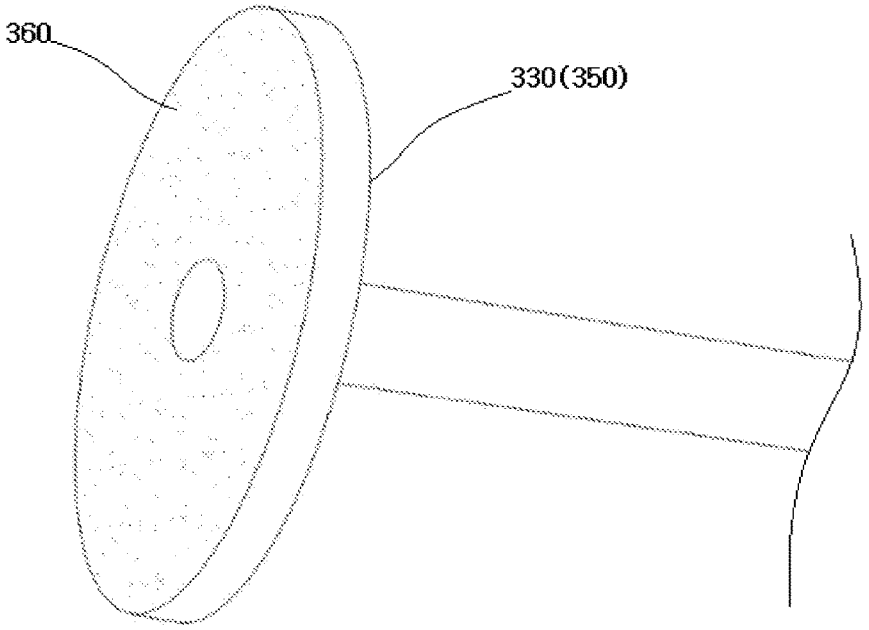

FIGS. 1 and 2 are exploded and assembled perspective views showing an embodiment of a 360-degree rotatable accessory according to the present invention, FIGS. 3 and 4 are exploded and assembled perspective views showing a second embodiment of a 360-degree rotatable accessory according to the present invention, and FIGS. 5 and 6 are a cross-sectional view and a perspective view showing main parts of a third embodiment of a 360-degree rotatable accessory according to the present invention.

Figure 7:
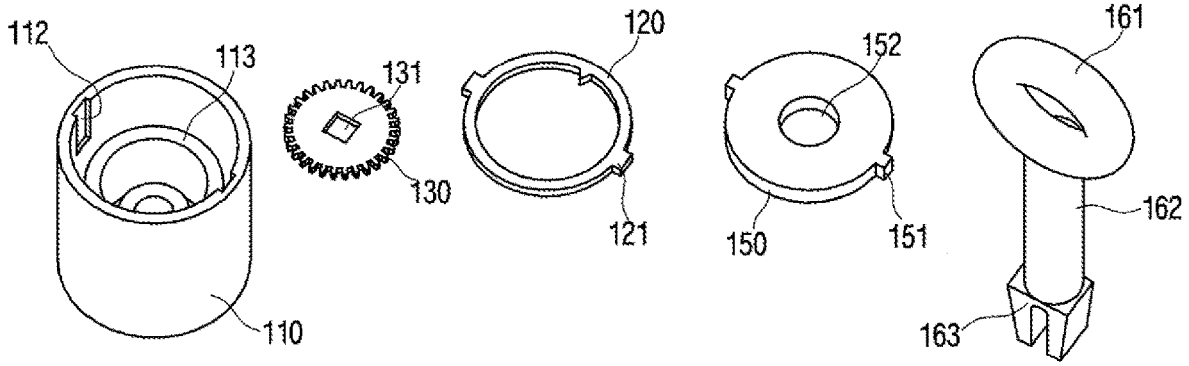
FIG. 7 is a view showing another embodiment of a first embodiment of the present invention.

FIG. 7 is a view showing another embodiment of a first embodiment of the present invention.

A first embodiment of a 360-degree rotatable accessory according to the present invention is described with reference to the drawings.

First, the accessory includes a body 110 that has an insertion groove 111 having a predetermined depth and formed at the center, slots 112 longitudinally formed on the inner sides of the insertion groove 111, and a seat 113 formed substantially around the inner side of the center.

An outer gear 120 having teeth around the inner side is disposed on the seat of the body 110 and projections 121 are formed on the outer side of the outer gear 120 to be guided and seated along the slots 112 of the body 110.

The outer gear 120 may have teeth formed around the entire inner side, as shown in FIG. 1, but is not limited thereto and may have one projection, as shown in FIG. 7.

An inner gear 130 having teeth around the outer side to be engaged with the outer gear 120 is disposed inside the outer gear 120 and a contact groove 131 is formed at the center of the inner gear 130.

The contact groove 131 may have various cross-sectional shapes such as a circle, a rectangle, and a hexagon, depending on coupling conditions.

A spring 140 is disposed under the seat 113 of the body and elastically supports the inner gear 130.

The spring 140, as shown in the figures, is a circular coil spring, but it would be apparent to those skilled in the art that the spring can be replaced by various elastic members such as a plate spring or a rubber member that has elasticity.

A cover 150 is disposed over the body 110 and has projections 151 on the outer side to correspond to the slots 112 and a hole formed through the center.

A rotary guider 160 is disposed over the cover 150. The rotary guider 160 has a ring 161 at the top, a guide rod 162 extending into the body 110 through the hole 152 of the cover 150, and a rectangular bar 163 formed at the lower end of the guide rod 162 to be fitted in the contact groove 131 of the inner gear 130.

The present invention is not limited to the rectangular bar and it should be noted that a bar having a triangular or more complex polygonal shape can be used.

According to the present invention having this configuration, the inner gear 130 and the outer gear 120 disposed on the seat 113 of the body 110 are in mesh with each other, so they cannot be rotated.

This is because the projections 121 of the outer gear 120 are fitted in the slots 112 of the body 110.

When the rotary guider 160 is pushed into the body 110 in this state, the rectangular bar 163 are guided downward in contact with the contact groove 131 of the inner gear 130, so the outer gear 120 and the inner gear 130 are disengaged and can be rotated.

That is, when the force is removed after rotation at a predetermined angle, the outer gear 120 and the inner gear 130 are engaged by elasticity of the spring 140 and the rotated position is firmly maintained.

Rotation of 360 degrees is possible by repeating this operation.

Next, a second embodiment of a 360-degree rotatable accessory according to the present invention is described.

The 360-degree rotatable accessory according to the second embodiment is divided into an outer body 210 and an inner body 220.

The outer body 210 has threads 211 having a predetermined length and formed upward from the body at the center on the inner side.

A tapered hole 212 that is declined, that is, has a conical cross-section is vertically formed from the thread 211.

The inner body 220, which is a part inserted upward into outer body 210, has threads 221 on the outer side to be thread-fastened to the threads 211 of the outer body 210 and has a tapered surface 222 at the upper end.

At least two or more slits 223 are longitudinally formed and arranged with regular intervals at the inner body 220 to apply or remove a fastening force to a hook 230 of the accessory through thread-fastening of the outer body 210.

The operational relationship of the accessory is described. First, the outer body 210 and the inner body 220 are thread-fastened with the lower end of the hook 230 on the inner body 220. Accordingly, the tapered surface 222 and the tapered hole 210 that are in contact with each other are moved such that the coupled portion is tightened and the upper end of the inner body 220 open by the slits 223 is narrowed and strongly tightens the lower end of the hook 230, whereby the hook cannot be rotated.

Further, when the bodies are rotated to be released, the tightening force is removed and the hook 230 can be rotated freely, that is, 360 degrees.

Finally, a third embodiment of a 360-degree rotatable accessory according to the present invention is described.

First, there is provided a body 310 that has threads 311 having a predetermined length and formed upward on the inner side of a lower portion and has a hole 312 at the center of an upper portion so that a hook 320 that is coupled to an accessory is guided therein.

The hook 320 has a disc-shaped first contact plate 330 at the lower end that is inserted in the body 310.

A coupler 340 is coupled to the lower portion of the body 310. The coupler 340 has a threaded rod to be thread-fastened to the threads 311 of the body 310 and a second contact plate 350, which is selectively brought in contact with the first contact plate 330, at the upper end of the threaded rod 341.

The coupler 340 is formed in a spherical shape in the figure, but it may be formed in various shapes including a diamond shape or a rectangular shape.

That is, depending on the thread-fastened state of the coupler 340 and the body 310, the first and second contact plates 330 and 350 are brought in contact with each other, thereby controlling rotation of the hook 320.

An anti-slip projection 360, that is, a kind of serration may be formed on at least any one of the contact surfaces facing each other of the first and second contact plates 330 and 350 in order to prevent slip.

However, the present invention is not limited thereto and a rubber body having a high anti-slip ability may be used.

Although exemplary embodiments of the present invention were illustrated and described above, the present invention is not limited to the specific exemplary embodiments and may be modified in various ways by those skilled in the art without departing from the scope of the present invention described in claims, and the modified examples should not be construed independently from the spirit of the scope of the present invention.

The invention claimed is:

1. A 360-degree rotatable accessory comprising:

a hook;

an outer body having threads formed upward from the body at a center on an inner side thereof and having a declined tapered hole formed in an upper portion, wherein a lower end of the hook is inserted into the declined tapered hole at the upper portion of the outer body; and an inner body fitted upward in the outer body, having threads on an outer side thereof to correspond to the outer body, having a tapered surface at an upper end, and having at least two or more slits formed from the upper end to a lower thread and arranged with regular intervals to apply or remove a tightening force to the lower end of the hook of the accessory through thread-fastening of the outer body, wherein the lower end of the hook is inserted into the upper end of the inner body via the declined tapered hole of the outer body.

2. A 360-degree rotatable accessory comprising:

a body having threads having a predetermined length, the threads being formed upward on an inner side of a lower portion thereof, and having a hole at a center of an upper portion so that a hook that is coupled to an accessory is guided therein;

a first contact plate having a disc shape and formed at a lower end of the hook inserted into the body in an inserting direction; and a coupler coupled upward to the body, having a threaded rod to be thread-fastened to the threads of the body, and having a second contact plate formed at an upper end of the threaded rod to be selectively brought in contact with the first contact plate, wherein the coupler further comprises a coupler body connected to the threaded rod, the coupler body has a diameter of a cross section that is larger than a diameter of a cross section of the body, and the cross section of the coupler body and the cross section of the body are orthogonal to the inserting direction.

3. The accessory of claim 2, wherein anti-slip projections for preventing slip are formed on a contact surface of at least one of the first and second contact plates.

4. The accessory of claim 2, wherein a shape of the cross section of the coupler body is at least one of a circle, a diamond and a rectangular.

5. A 360-degree rotatable accessory comprising:

a body having threads having a predetermined length, the threads being formed upward on an inner side of a lower portion thereof, and having a hole at a center of an upper portion so that a hook that is coupled to an accessory is guided therein;

a first contact plate having a disc shape and formed at a lower end of the hook inserted in the body; and a coupler coupled upward to the body, having a threaded rod to be thread-fastened to the threads of the body, and having a second contact plate formed at an upper end of the threaded rod to be selectively brought in contact with the first contact plate, wherein a contact surface of at least one of the first and second contact plates comprises a rubber material for preventing slip.

* * * * *